US010250000B2

(12) United States Patent
Plamondon et al.

(10) Patent No.: US 10,250,000 B2
(45) Date of Patent: Apr. 2, 2019

(54) CABLE ASSEMBLY TOOL

(71) Applicant: BELDEN CANADA INC., Saint-Laurent (CA)

(72) Inventors: Jean-Sébastien Plamondon, Laval (CA); Arthur Becquart, Montreal (CA); Luc Milette, Montreal (CA); Benoit Chevarie, Boisbriand (CA); Vincent Pilon, Montreal (CA)

(73) Assignee: BELDEN CANADA INC., Saint-Laurent (CA)

( * ) Notice: Subject to any disclaimer, the term of this patent is extended or adjusted under 35 U.S.C. 154(b) by 172 days.

(21) Appl. No.: 15/369,021

(22) Filed: Dec. 5, 2016

(65) Prior Publication Data

US 2017/0162996 A1 Jun. 8, 2017

Related U.S. Application Data

(60) Provisional application No. 62/263,142, filed on Dec. 4, 2015.

(51) Int. Cl.

| | |
|---|---|
| ***H01R 43/01*** | (2006.01) |
| ***H01R 43/22*** | (2006.01) |
| ***H01R 107/00*** | (2006.01) |

(52) U.S. Cl.
CPC ..... *H01R 43/015* (2013.01); *H01R 43/22* (2013.01); *H01R 2107/00* (2013.01)

(58) Field of Classification Search
CPC ..... H01R 43/015; H01R 43/22
See application file for complete search history.

(56) References Cited

U.S. PATENT DOCUMENTS

| | | | | |
|---|---|---|---|---|
| 4,136,441 A | | 1/1979 | Neale, Sr. | |
| 5,109,591 A | * | 5/1992 | Hung | B25B 7/22 29/33 M |
| 5,647,119 A | | 7/1997 | Bourbeau et al. | |

FOREIGN PATENT DOCUMENTS

| | | | | |
|---|---|---|---|---|
| CA | 1082432 A1 | | 7/1980 | |
| CA | 1325714 C | | 1/1994 | |
| CA | 2487568 A1 | | 5/2005 | |
| DE | 3931864 C1 | * | 10/1990 | H01R 43/22 |

OTHER PUBLICATIONS

International Search Report of corresponding application No. PCT/CA2016/051424.

* cited by examiner

*Primary Examiner* — Livius Radu Cazan
(74) *Attorney, Agent, or Firm* — Hugh Mansfield

(57) ABSTRACT

A tool comprising a receptacle for receiving and holding a cable terminating assembly comprising a plurality of conductors and a plurality of piercing contacts, the tool comprising a pair of handles which actuate opposed presses and blades, the presses pushing the piercing contacts into the conductors while the blades trim the ends of the conductors.

18 Claims, 13 Drawing Sheets

CABLE ASSEMBLY TOOL

FIELD OF THE INVENTION

The present invention relates to a cable assembly tool. In particular, the present invention relates to a tool for receiving a cable terminator comprising piercing contacts arranged adjacent respective conductors and interconnecting the piercing contacts with the conductors.

BACKGROUND TO THE INVENTION

The prior art reveals a number of tools for terminating cables at a connector. One drawback of these prior art tools is that they allow the tool to be actuated before the connector is completely inserted into the device, and such that a substandard termination is arrived at. Additionally, no feedback is provided to the user to indicate that the connector is completely inserted into the tool.

SUMMARY OF THE INVENTION

In order to address the above and other drawbacks, there is provided a tool for interconnecting a plurality of piercing contacts with respective ones of a plurality of insulated conductors to form a connector assembly, each of the conductors arranged in parallel and at least one of the conductors exposed on each of a pair of opposed outer surfaces of the wire guide, each of the piercing contacts retained in a cap and such that when the cap is placed over the wire guide each of the piercing contacts is aligned with the respective ones of the conductors. The tool comprising a receptacle defining an axis and comprising an opening dimensioned for receiving the cap, wire guide and insulated conductors and a back wall opposite the opening; a retaining plate adjacent the opening, the retaining plate moveable between a retaining position wherein the retaining plate projects into the opening and an inserting position wherein the retaining plate is outside of the opening; a pair of flat blades arranged in parallel and in an opposed relationship on opposite sides of the receptacle between the opening and the back wall, the blades moveable towards one another into a cutting position; a pair of presses in an opposed relationship on opposite sides of the receptacle between the opening and the back wall, each of the presses adjacent a respective one of the blades and arranged for movement therewith into a pressing position; wherein the back wall comprises a push plate moveable along the axis towards the opening between a locked position, wherein the push plate is positioned between the pairs of blades and the pairs of presses thereby preventing their movement, and an unlocked position, wherein the push plate is not positioned between the pairs of blades and the pairs of presses; and a pair of elongate actuating handles moveable at right angles to the axis into an actuated position, each of the handles connected to a respective one of the blades; wherein the push plate is moveable from the locked position to the unlocked position through insertion of the cap and wire guide completely into the receptacle and such that the retaining plate moves from the inserting position to the retaining position, and further wherein when in the unlocked position, movement of the handles into the actuated position moves each of the blades into the cutting position and each of the presses into the pressing position.

BRIEF DESCRIPTION OF THE DRAWINGS

FIGS. 2A through 2D provided raised right perspective views of a wire guide, cap and cable detailing installation and in accordance with an illustrative embodiment of the present invention;

DETAILED DESCRIPTION OF THE ILLUSTRATIVE EMBODIMENTS

Figure 1A:
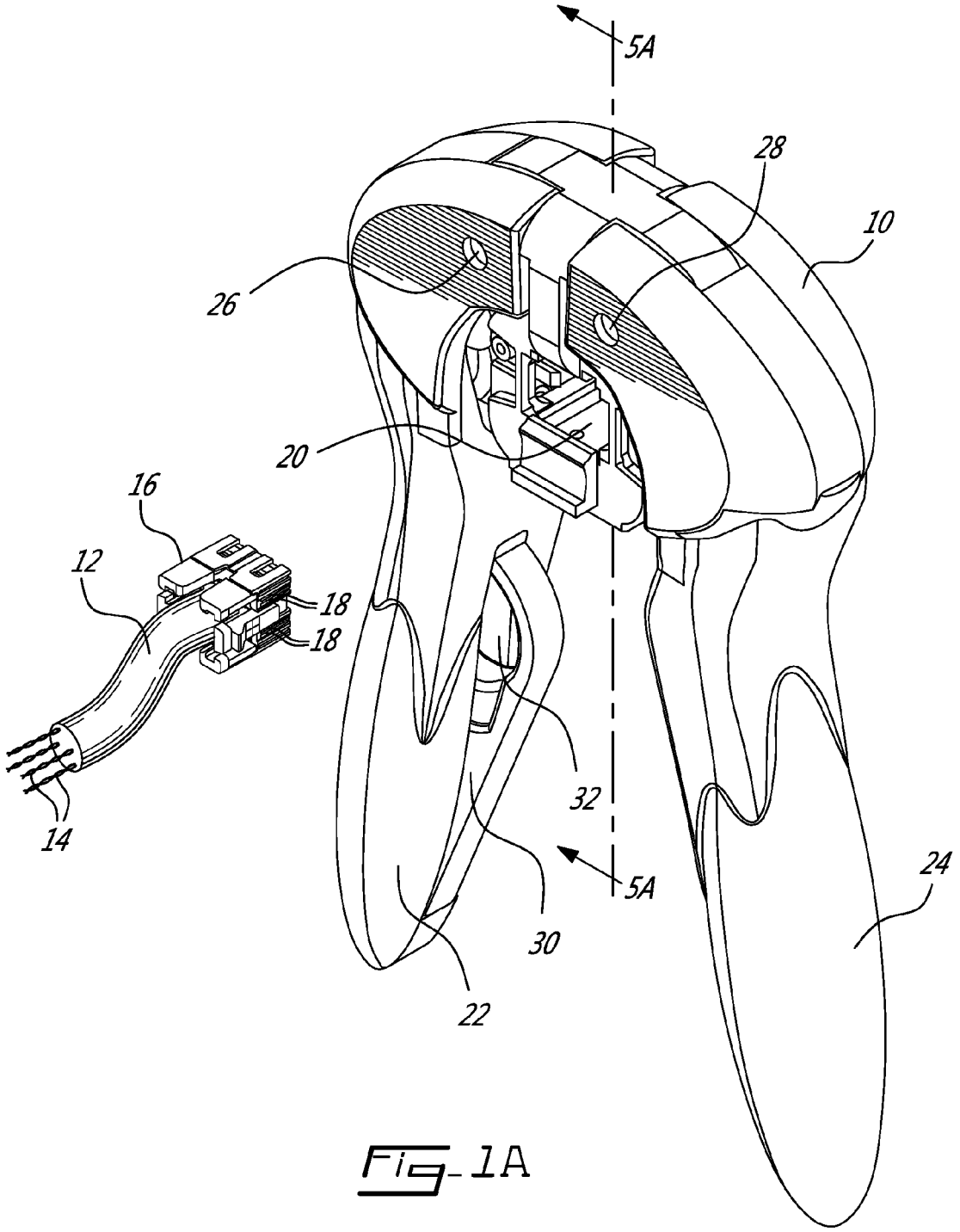
FIG. 1A is an isometric view of a cable assembly tool and a prepared cable in accordance with an illustrative embodiment of the present invention.

Referring now to FIG. 1A, a core assembly tool, generally referred to using the reference numeral 10, will now be described. The tool 10 is for aiding in the termination cables to form a cable assembly, such as a twisted pair telecommunication cable 12 comprising four (4) twisted pairs of insulated conductors 14 terminated at one end with a wire guide and cap assembly 16 comprising a plurality of piercing contacts 18. The tool 10 comprises a receptacle 20 for receiving the wire guide and cap assembly 16, and two elongate actuating handles 22, 24 which pivot about respective hinges 26, 28. A cable preparation tool 30, as will be described in more detail below, may be provided in a slot 32 in one of the handles 22, 24.

Figure 1B:
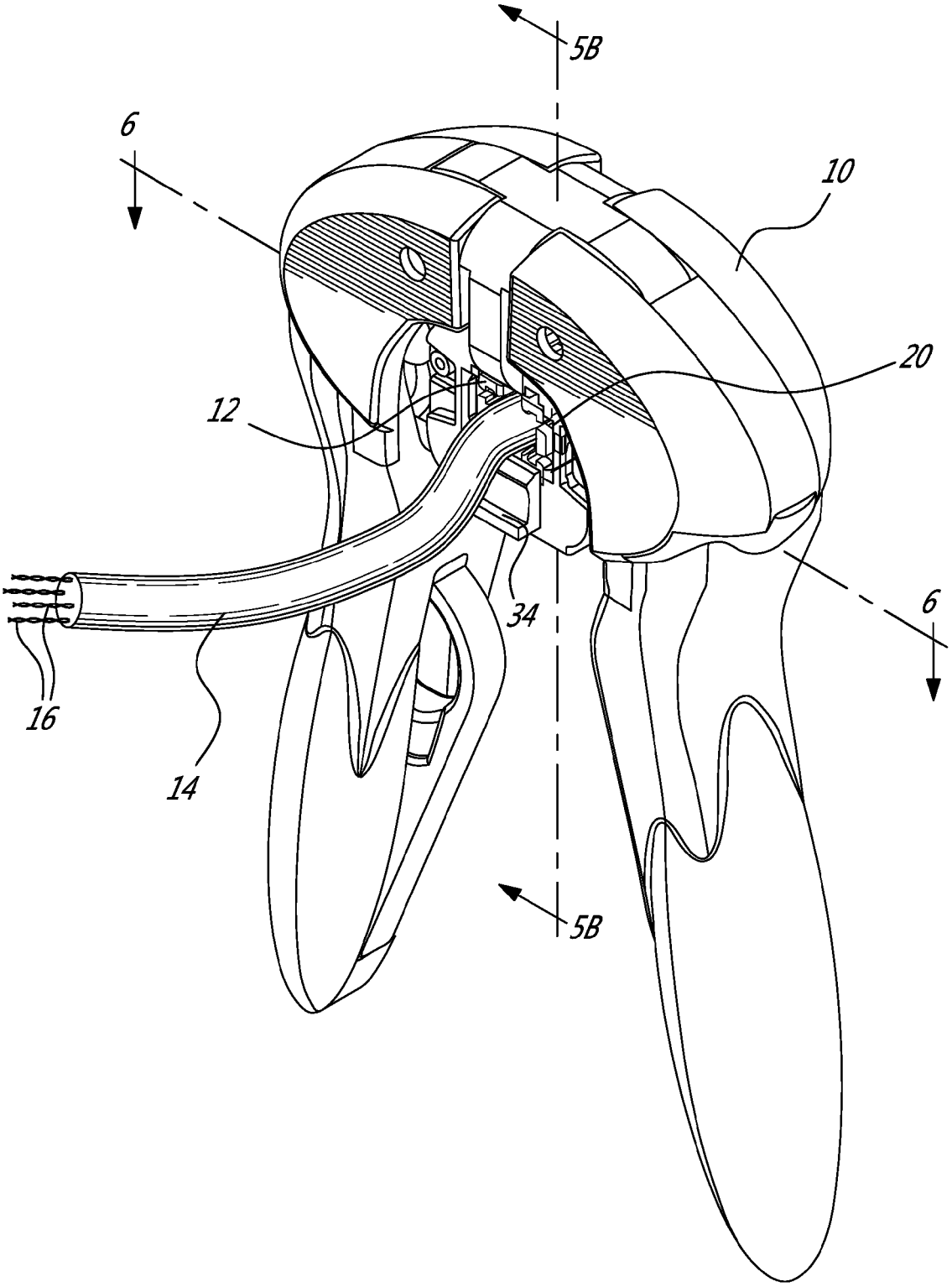
FIG. 1B is an isometric view of a cable assembly tool with a prepared cable installed in accordance with an illustrative embodiment of the present invention.

Referring now to FIG. 1B, the wire guide and cap assembly 16 is insertable into the receptacle 20. Once the wire guide and cap assembly 16 are inserted completely into the receptacle 20 a retaining plate 34 engages a rearward edge of the wire guide and cap assembly 16 thereby assuring that the wire guide and cap assembly 16 is held snugly within the receptacle 20 during actuation.

Figure 2C:
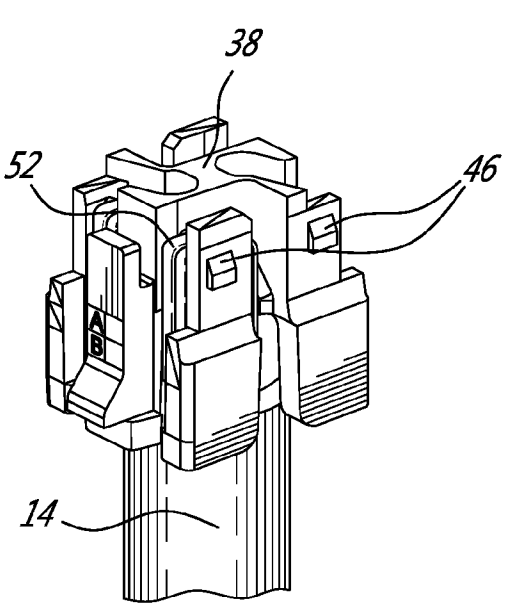
Figure 2B:
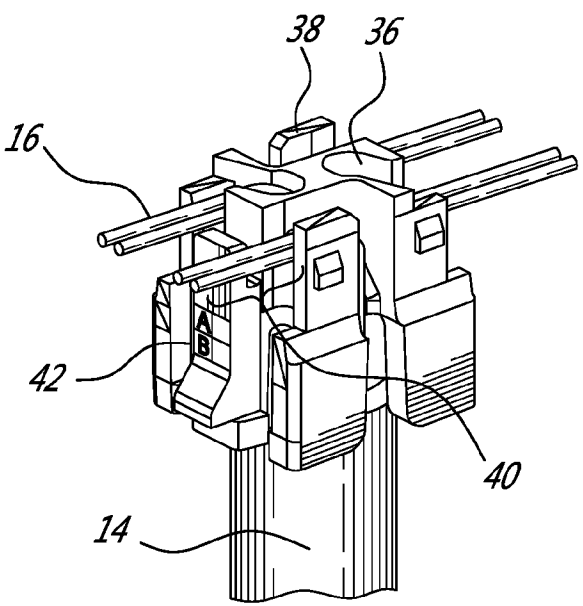
Figure 2A:
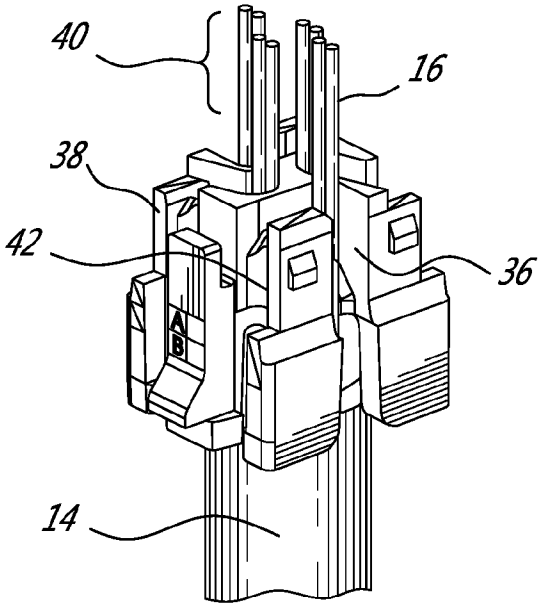
Figure 20:
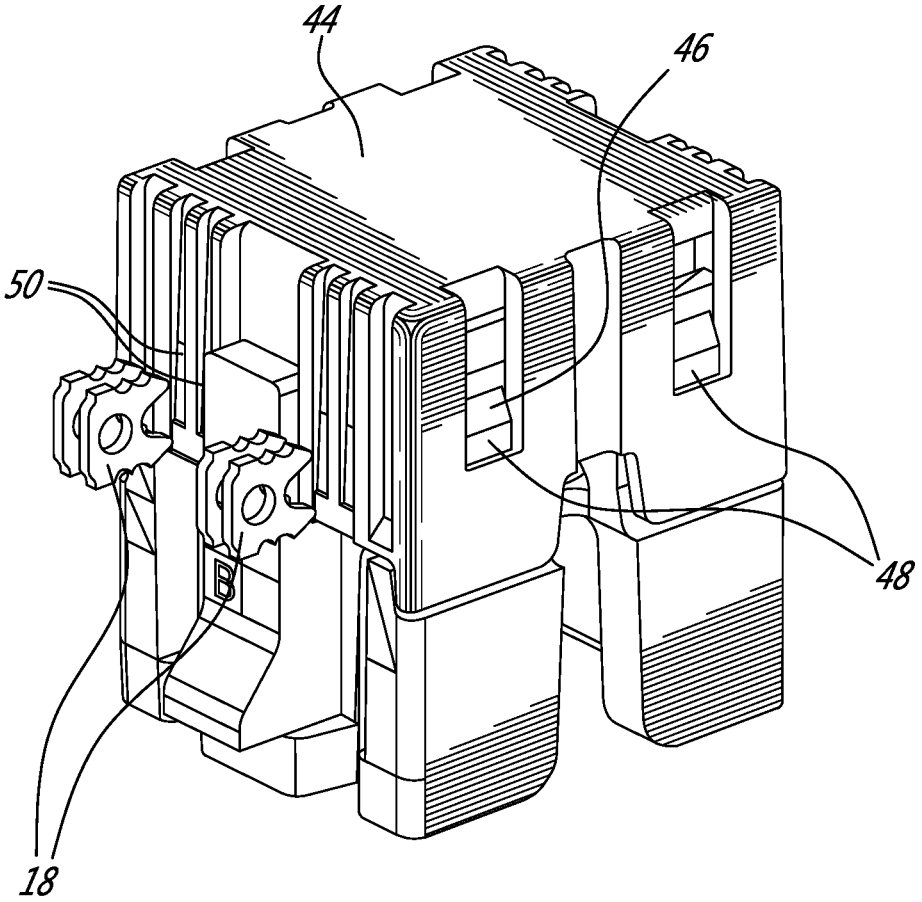

Referring now to FIGS. 2A through 2C, in order to prepare the cable 14 for termination, respective (twisted) pairs of conductors 16 are fed into predefined openings 36 in the wire guide 38, an end portion 40 of each twisted pair of conductors 16 is then untwisted, straightened and arranged in parallel and the pairs of conductors placed into respective slots 42 in the wire guide 38 and such that a piercing portion thereof is exposed on an outer surface of the wire guide 38. Referring to FIG. 2D in addition to FIG. 2C, a cap 44 is then placed over the wire guide 38/cable 14 assembly and secured by ensuring that a plurality of tabs 46 on the wire guide 38 engage with respective openings 48 in the cap 44. The piercing contacts 18 are illustratively held in slots 50 in the cap 44, although in a particular embodiment the piercing contacts 18 could be inserted into their respective slots 50 following assembly of the cap 44 to the wire guide 38. When the cap 44 is secured on the wire guide 38/cable 14 assembly, the slots 50 align with respective ones of the conductors 18. As will be discussed in more detail below, insertion of the piercing contacts 18 into their respective slots 50 by the tool 10 results in the piercing contacts 18 each piercing the insulated housing 52 surrounding their respective conductors 16 and such that the piercing contacts 18 come into contact with the conductive core.

Figure 3:
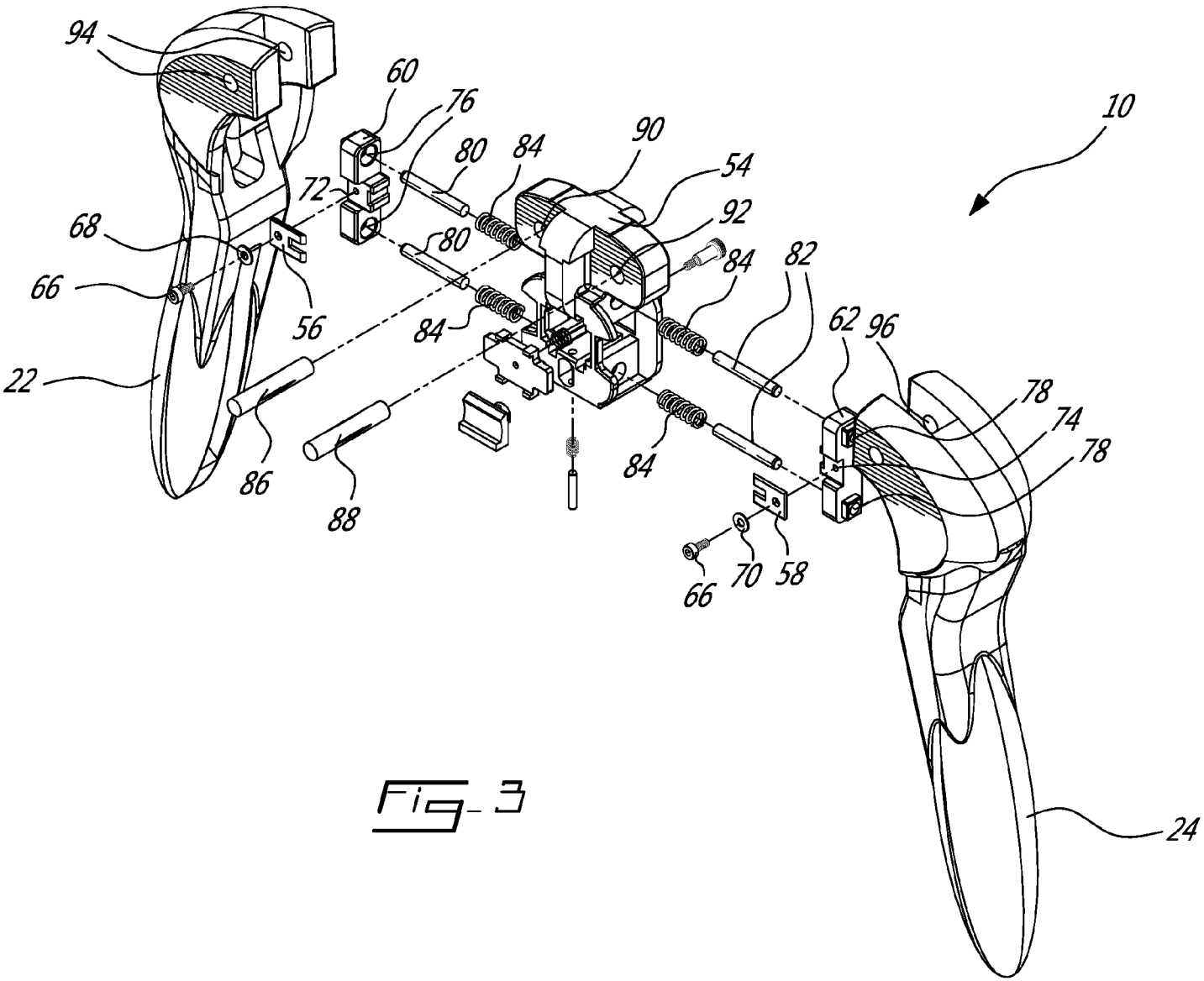
FIG. 3 is an exploded isometric view of a cable assembly tool in accordance with an illustrative embodiment of the present invention.

Referring now to FIG. 3, in addition to the handles 22, 24 as described above, the tool 10 comprises a tooling 54 comprising pairs of opposed flat blades 56, 58 arranged in parallel which are illustratively removeably attached to respective elongate blocks or presses 60, 62 using Allen bolts 64, 66 and washers 68, 70 and which engage respective threaded bores 72, 74 machined or otherwise formed in the elongate blocks 60, 62. The elongate blocks 60, 62 each comprise a pair of bores 76, 78 which receive respective pairs of rods 80, 82 and along which the elongate blocks 60, 62 are free to slide. Springs 84 are provided on each of the rods to bias the elongate blocks 60, 62, and therefore the blades 56, 58 and the handles 22, 24 away from each other. The elongate handles 22, 24 are each pivotally mounted to the tooling 54 at one end via a respective one of a pair of pins 86, 88 which are engaged in respective bores 90, 92 in the tooling 54 and bores 94, 96 in the ends of the handles 22, 24.

Figure 4:
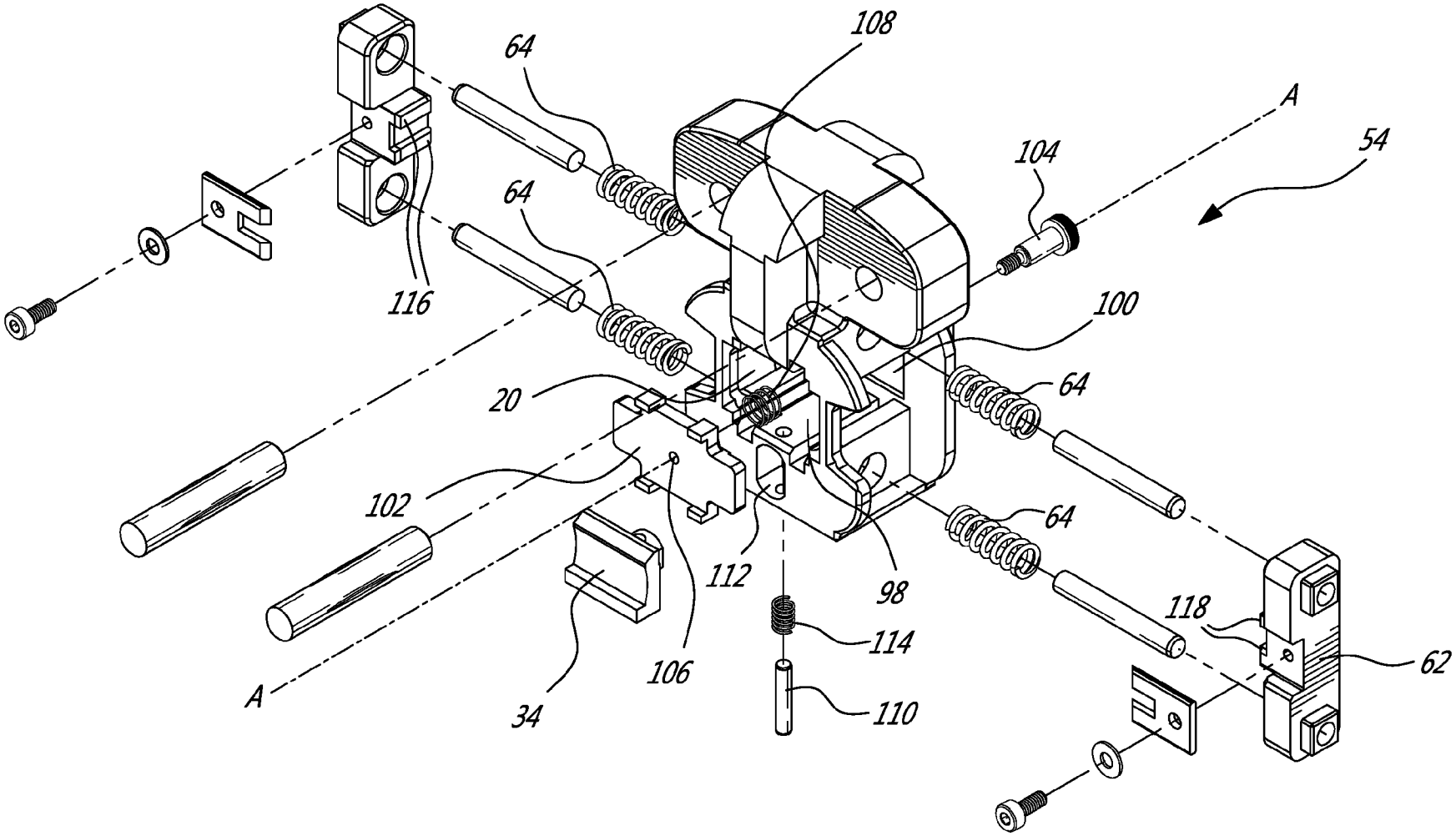
FIG. 4 is a exploded isometric detail view of a tooling of a cable assembly tool in accordance with an illustrative embodiment of the present invention.

Referring now to FIG. 4, the tooling 54 defines the receptacle 20 which as discussed above is dimensioned to receive a wire guide and cap assembly. The receptacle 20 comprises an opening 98 dimensioned for receiving wire guide and cap assembly 16 and a back wall 100 opposite the opening 98 comprising a push plate 102 and defines an axis A-A. The push plate 102 is retained within the receptacle 20 by a threaded Allen bolt 104 which is held in a bore (not shown) and engaged in a threaded bore 106 in the push plate 102. A spring 108 positioned about the Allen bolt 104 and between the back wall 100 and the push plate 102 biases the push plate 102 towards the opening 98 but allows the push plate 102 to move with and against the biasing force along the axis A-A. The retaining plate 34 is slideably mounted to a pin 110 exposed within a passage 112 in the tooling 54. The retaining plate 34 is moveable along the pin 110 along a path positioned at right angles to the axis A-A between a retaining position and an inserting position. The retaining plate 34 is biased long the path at right angles to the axis A-A and towards the retaining position into the opening 102 by a first spring 114 mounted about the pin 110. In the retaining position the retaining plate 34 projects into the opening 98. The blades 56, 58 are positioned within the receptacle 20 on either side and spaced between the opening 98 and the back wall 100. The opposed blades 56, 58 are moveable towards each other into a cutting position.

Still referring to FIG. 4, as discussed above, the elongate blocks or presses 60, 62 move with and against the force of a plurality of second biasing springs 64 towards and away from the receptacle, i.e. at right angles to the axis A-A. The elongate blocks 60, 62 further comprise respective pairs of piercing contact-engaging chucks 116, 118 mounted on a receptacle facing side thereof and which, as will be discussed in more detail below, are used to engage and drive the piercing contacts (reference 18 in FIG. 1A) into contact with their respective conductors 18.

Figure 5B:
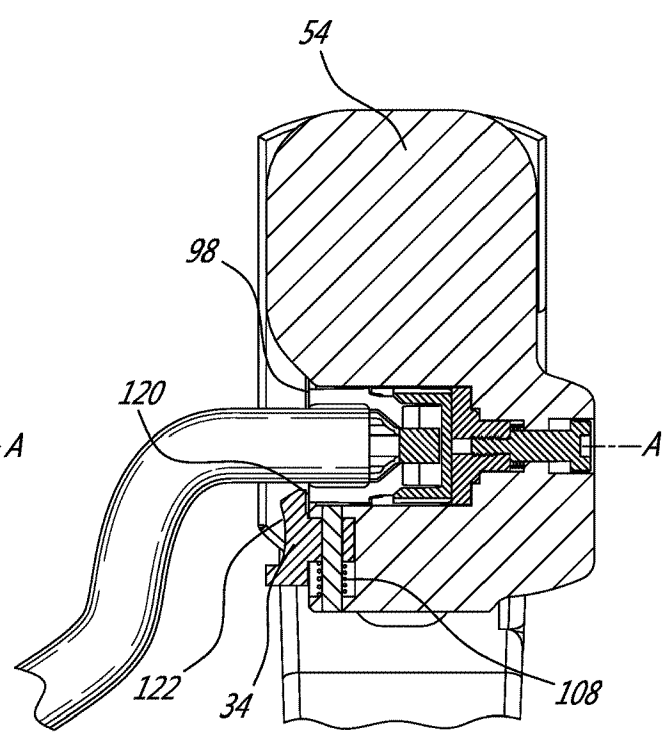
FIG. 5B is a cross section along line VB-VB in FIG. 1B.
Figure 5A:
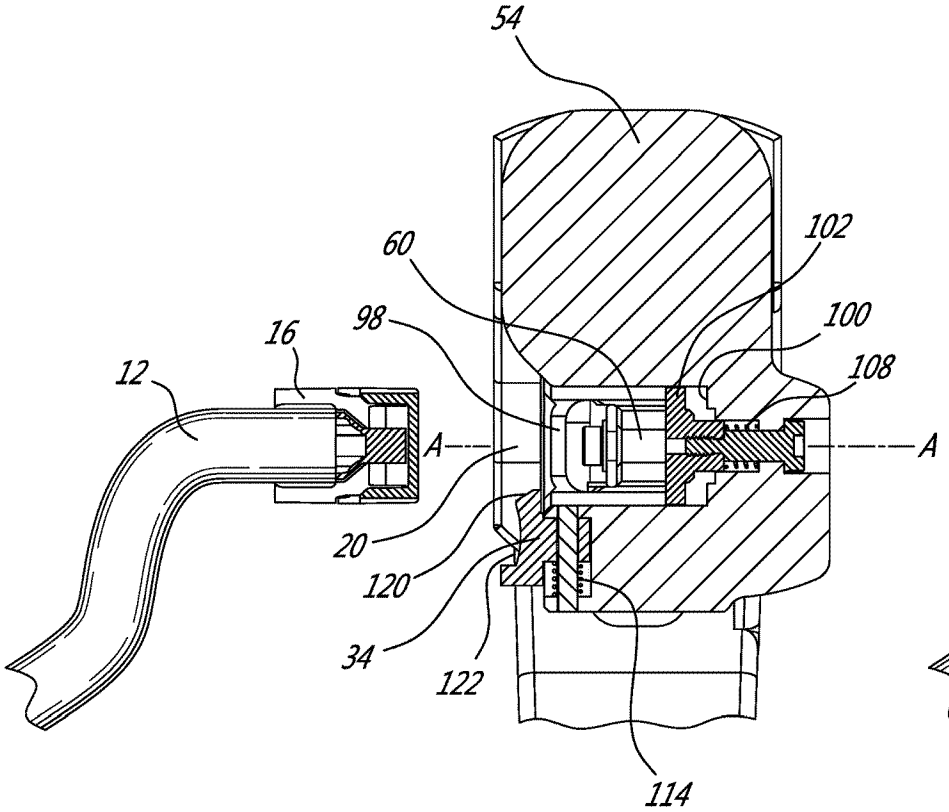
FIG. 5A is a cross section along line VA-VA in FIG. 1A.

Referring now to FIG. 5A, as discussed above, the push plate 102 is biased away from the back wall 100 towards the opening 98 and into a locked position by a third spring 108 along the axis A-A and is positioned between the elongate blocks 60, 62, thereby preventing the tool 10 from being inadvertently actuated. As the wire guide and cap assembly 16 is inserted into the receptacle 20 via the opening 98, the cap 44 first engages the chamfered edge 120 of the retaining plate 34 thereby forcing the retaining plate 34 out of the opening 98 against the bias of the retaining plate spring 114 into the inserting position. The cap 44 subsequently comes into contact with the push plate 102 forcing it against the back wall 100 against the bias of the push plate spring 108 and into an unlocked position.

Referring now to FIG. 5B, once the wire guide and cap assembly 16 has been fully inserted into the receptacle 20, the retaining plate 34 moves with the retaining plate spring 114 into the opening, thereby securing the wire guide and cap assembly 16 within the receptacle 20 via an upper edge 120 of the retaining plate 34. As the push plate 102 is against the back wall 100, the push plate 102 is no longer positioned between the elongate blocks 60, 62, thereby allowing the tool 10 to be actuated.

The wire guide and cap assembly 16 can be released from the receptacle 20 by moving the retaining plate 34 against the bias of the retaining plate spring 114, for example by the user moving his thumb against the profiled outer surface 122 of the retaining plate 34.

Figure 1C:
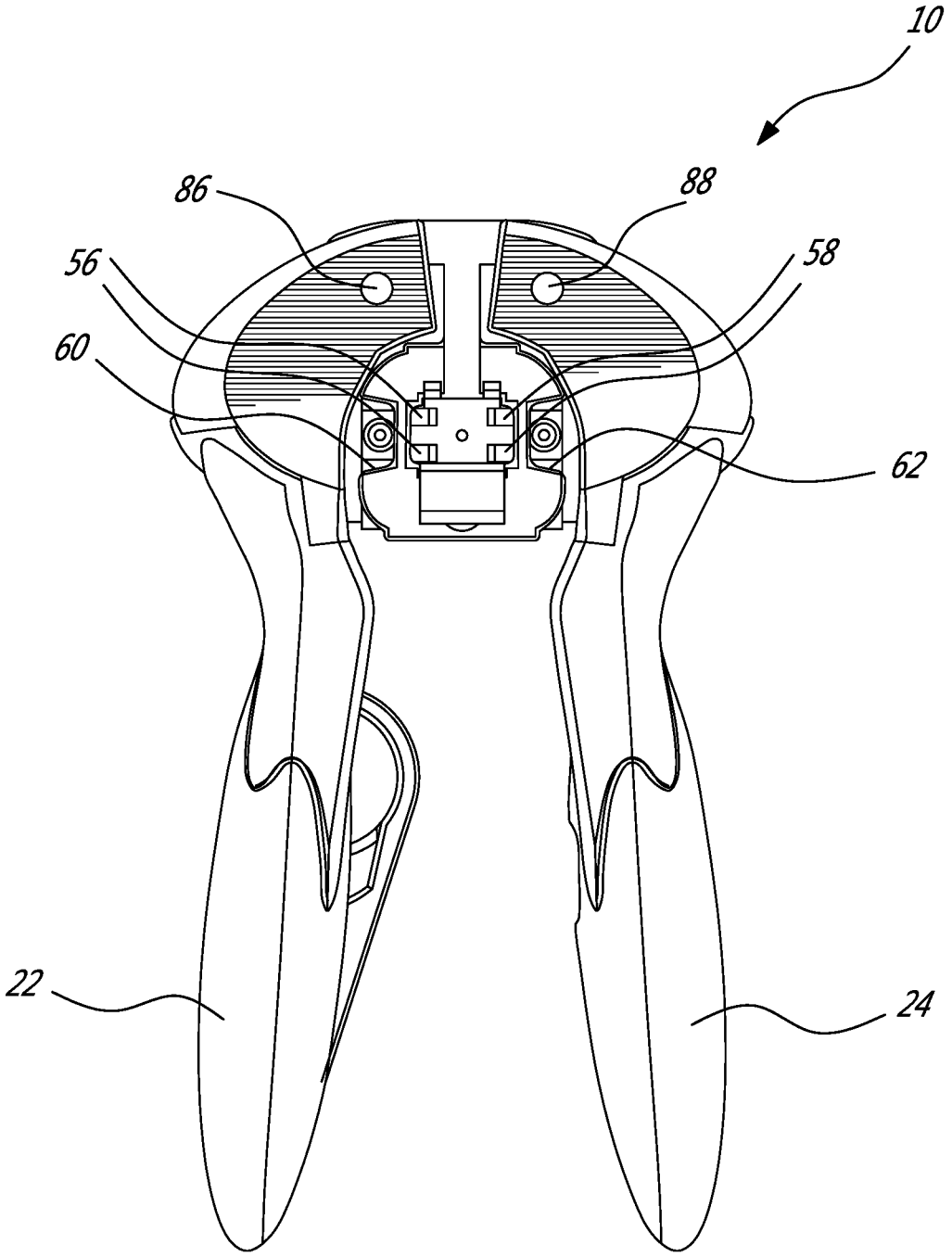
FIG. 1C is a front plan view of a cable assembly tool and prepared cable in accordance with an illustrative embodiment of the present invention.
Figure 6:
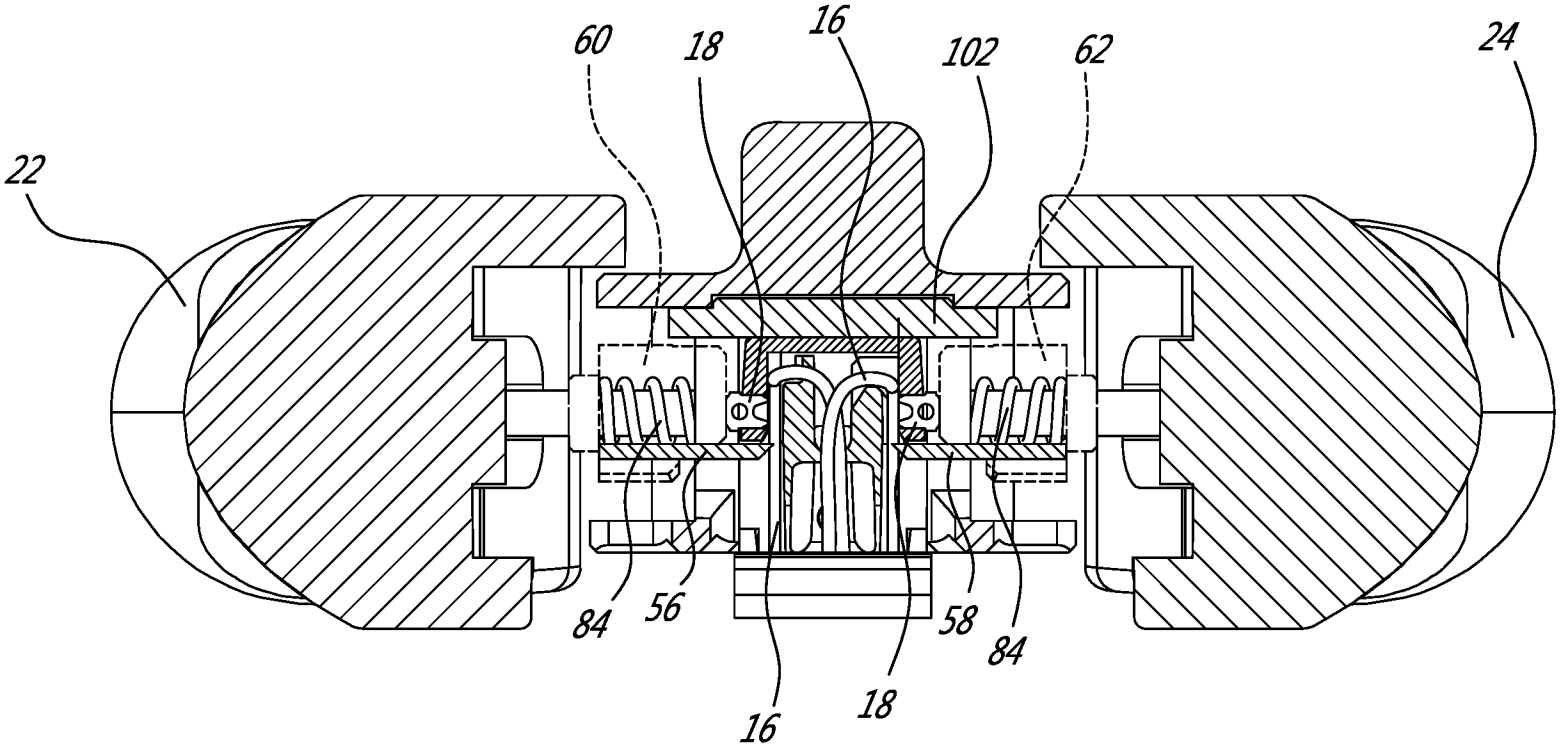
FIG. 6 is a cross section along line VI-VI in FIG. 1B.

Referring now to FIG. 6, as discussed above once the wire guide and cap assembly 16 is fully inserted into the receptacle 20, the push plate 102 is no longer positioned between the elongate blocks 60, 62. Referring to FIG. 1C in addition to FIG. 6, the tool 10 can now be actuated by gripping the handles 22, 24 together causing the handles 22, 24 to pivot in parallel to axis A-A about their respective pins 86, 88 and moving the elongate blocks 60, 62 towards one another. As the elongate blocks 60, 62 move towards one another, the pairs of blades 56, 58 engage and cut the ends of their respective conductors 14 while the faces of the chucks 116, 118 engage their respective piercing contacts 18 and such that the piercing contacts 18 penetrate the conductor insulation coming into contact with the conductive core of their respective conductors 16.

Still referring to FIG. 6, on release of the handles 22, 24 the pair of elongate blocks 60, 62, opposed blades 56, 58 and opposed faces of the chucks 116, 118 are moved away from another by the biasing force of the springs 84. Referring back to FIG. 1B in addition to FIG. 6, as discussed above, the wire guide, cap and cable assembly 16 can now be released from the receptacle 20 by moving the retaining plate 34 against the bias of the retaining plate spring 114, for example by the user moving his thumb against the profiled outer surface 122 of the retaining plate 34.

Figure 7B:
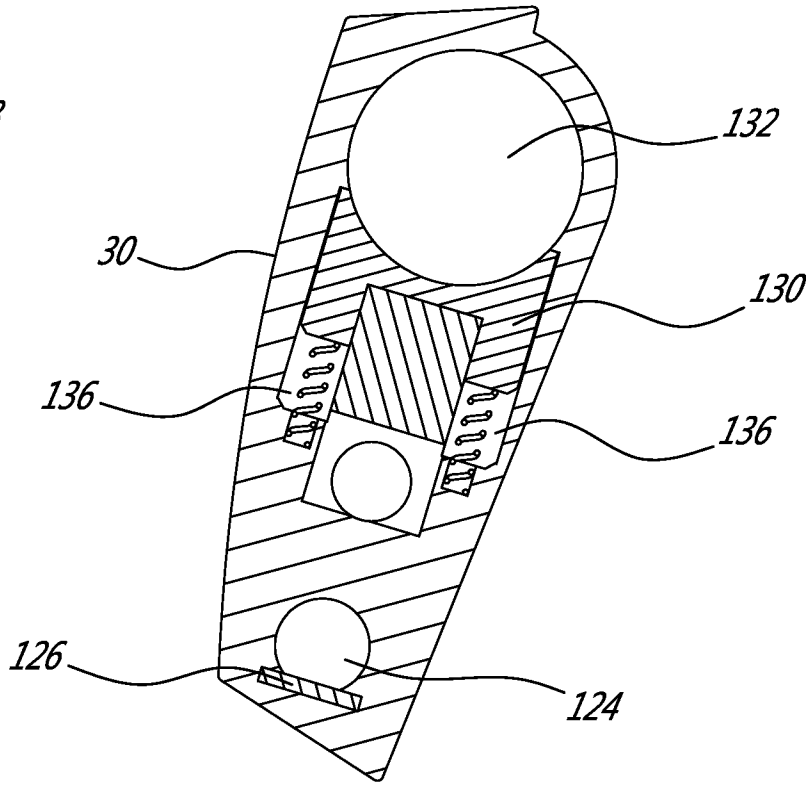
FIG. 7B is a sectional view along line VIIB-VIIB in FIG. 7A.
Figure 7A:
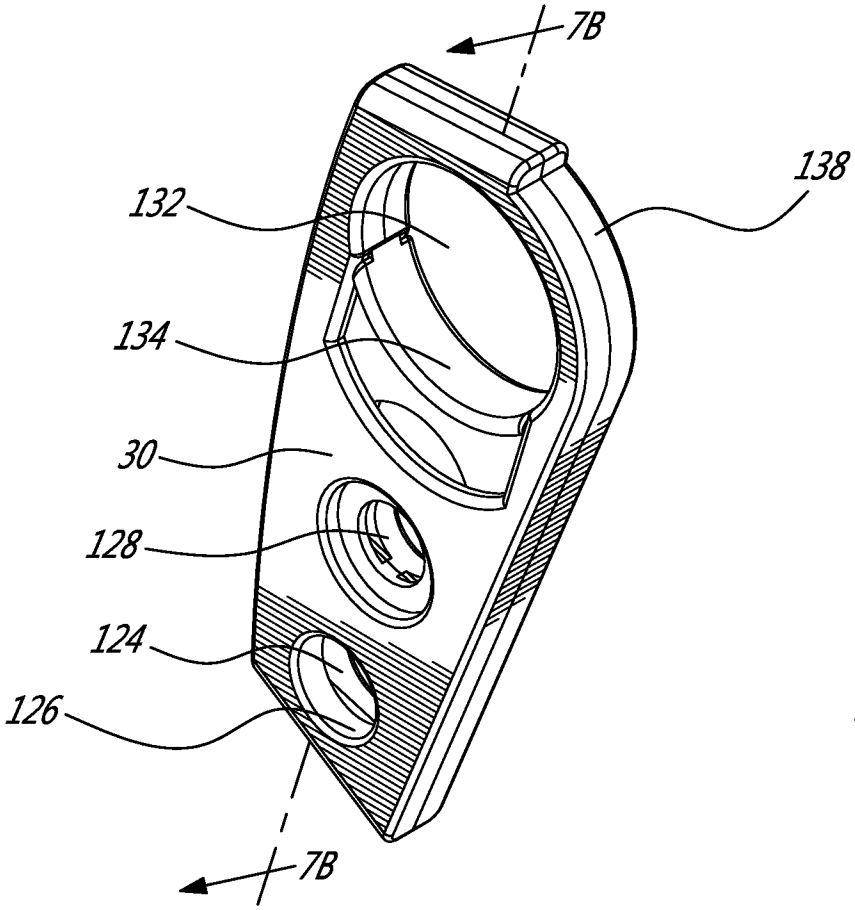
FIG. 7A is an isometric view of a cable preparation tool in accordance with an illustrative embodiment of the present invention.

Referring now to FIGS. 7A-7B, as discussed above the tool illustratively includes a cable preparation tool 30, which will now be described. The cable preparation tool 30 comprises a first aperture 124 dimensioned for receiving a cable comprising a jacket (both not shown) and into which a thin cut may be introduced, illustratively by rotating the cable jacket against a first blade 126 mounted with a predetermined depth on an inner wall of the first aperture 124. There is also provided a second aperture for removing the spline or separator from between the twisted pairs of conductors (both not shown) comprising a second aperture 128 dimensioned to receive the spline and a second guillotine-like blade 130. The user actuates the second blade 130 by inserting his thumb or finger onto a third aperture 132 and pressing against a plunger 134 towards the second aperture causing the second blade 130 to move into the second aperture 128 and sever the spline. The plunger 134 is biased towards the third aperture 132 by a spring 136 and such that the second blade retracts out of the second aperture 128 and returns within the housing 138 when not in use.

Figure 8A:
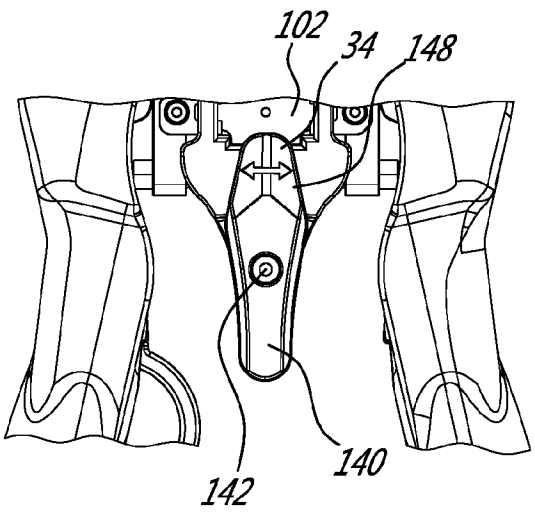
FIGS. 8A and 8B provide front plan views detailing a tooling of a cable preparation tool and in accordance with an alternative illustrative embodiment of the present invention.
Figure 8B:
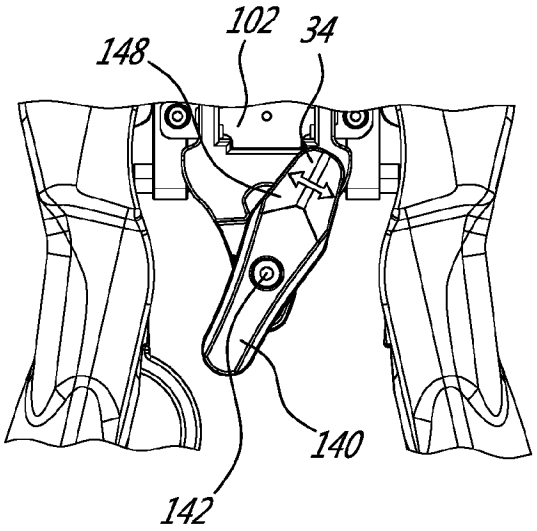
Figure 8C:
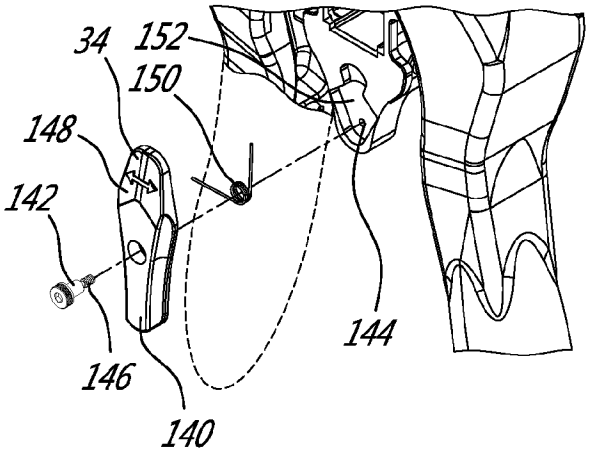
FIG. 8C provides an exploded isometric view detailing a tooling of a cable preparation tool and in accordance with an alternative illustrative embodiment of the present invention.

Referring now to FIGS. 8A through 8C, in a first alternative embodiment of the present invention, the retaining plate 34 comprises an elongate member 140 which, in a normal position (FIG. 8A) extends in front of the push plate 102. An Allen bolt 142 is illustratively used to mount the elongate member 140 pivotally to the tooling 54 via a threaded bore 144 in the tooling 54 which is engaged by the threaded end 146 of the bolt 142. The elongate member 140 further comprises a bevelled upper end 148. In operation, the wire guide and cap assembly (reference 16 in FIG. 1) is inserted into the tool 10 by either articulating the lower end of the elongate member 140 such that it rotates about the Allen bolt 142 thereby freeing the receptacle 20 of the upper end 148 of the elongate member 140 (FIG. 8B) or alternatively by pressing the wire guide and cap assembly 16 against one or other of the bevelled upper end 148 and such that the upper end 148 is deflected to the side. Once the wire guide and cap assembly 16 has been inserted into the receptacle 20 the elongate member is returned to its normal position via biasing forces generated by a spring 150 which is held within a recess 152 within the tooling 54. In order to release the wire guide and cap assembly 16, the lower end of the elongate member 140 is articulated such that it rotates about the Allen bolt 142 thereby freeing the wire guide and cap assembly 16 which is then ejected from the receptacle 20 by the push plate 102.

Figure 9:
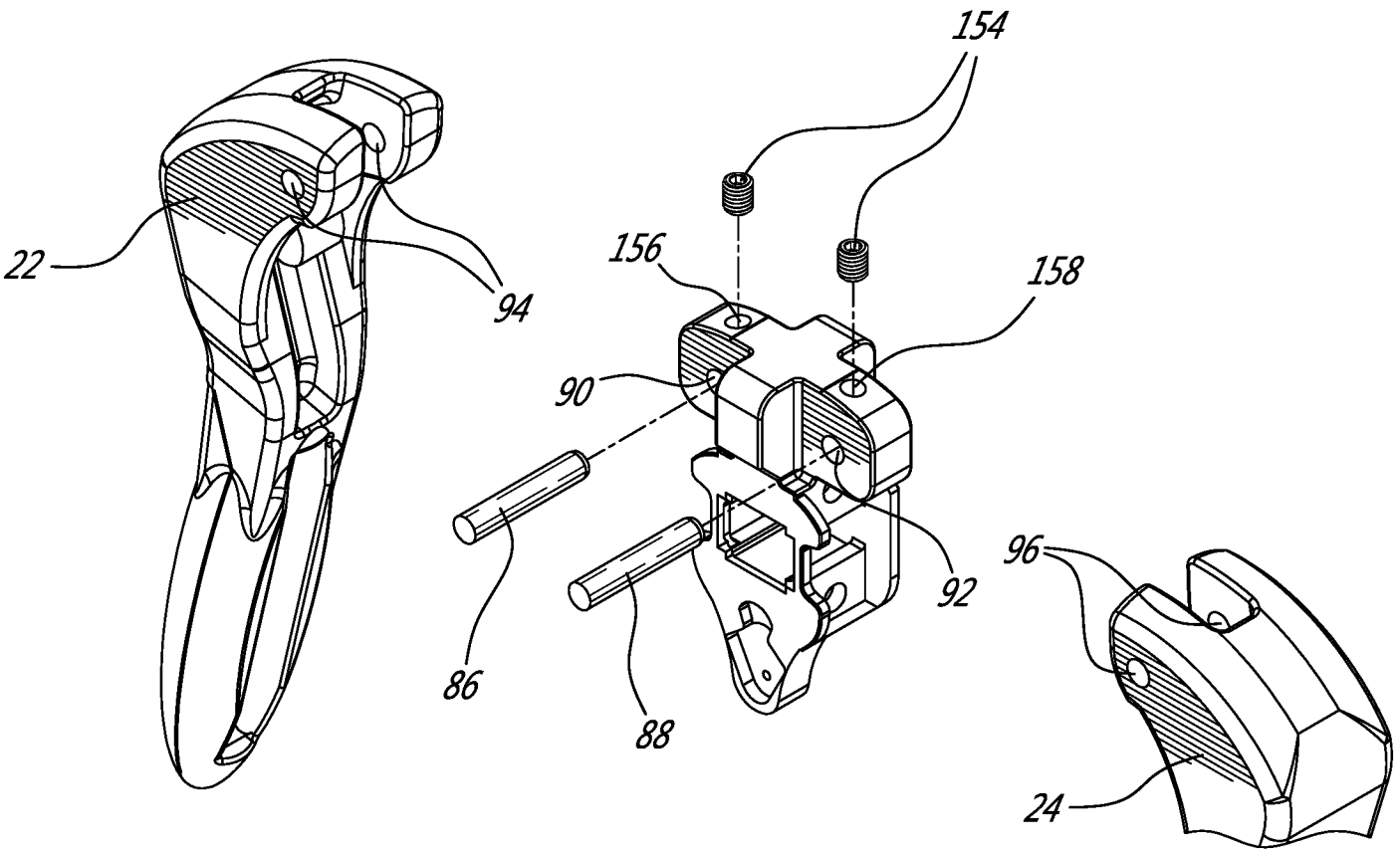
FIG. 9 provides an exploded isometric view detailing a tooling of a cable preparation tool and in accordance with a second alternative illustrative embodiment of the present invention.

Referring now to FIG. 9, in a second alternative illustrative embodiment, the handles 22, 24 are mounted to the tooling 54 via respective ones of a pair of pins 86, 88 which are received in respective transverse bores 90, 92 in the tooling 54 and respective bores 94, 96 in the handles 22, 24. The pins 86, 88 are removeably-secured within the respective bores 90, 92 via a pair of set screws 154 which are received in respective ones of a pair of threaded bores 156, 158 arranged at right angles to and intersecting with respective ones of the transverse bores 90, 92. Removeably-securing the handles 22, 24 in this fashion allows for simpler replacement of blades (references 56, 58 in FIG. 1), for example when they are worn or broken or the like.

Figure 10:
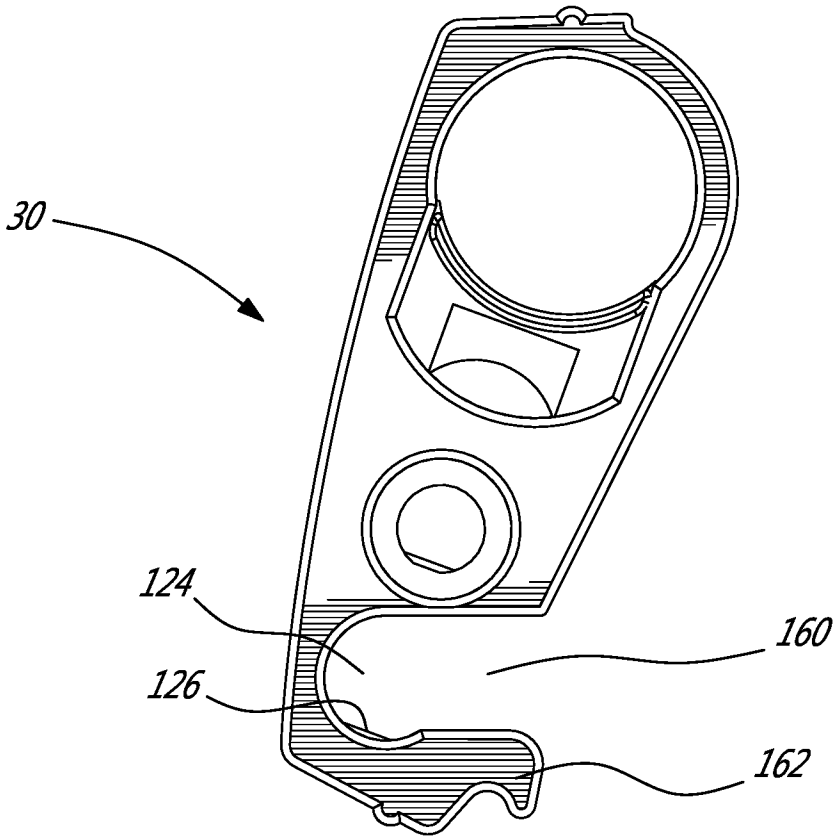
FIG. 10 provides a front plan view of a cable preparation tool in accordance with an alternative embodiment of the present invention.

Referring now to FIG. 10, in an alternative embodiment of the cable preparation tool 30, the first aperture 124 may comprise a side opening 160 and such that a cable comprising a jacket (both not shown) can be inserted. Again, as discussed above, a thin cut may be introduced into the cable jacket by illustratively rotating the cable jacket against the first blade 126 mounted with a predetermined depth on an inner wall of the first aperture 124. Referring back to FIG. 1 in addition to FIG. 10, a hook portion 162 may be also provided to simplify retraction of the preparation tool 30 from its slot 32 in the handle 22 of the tool 10.

Although the present invention has been described hereinabove by way of specific embodiments thereof, it can be modified, without departing from the spirit and nature of the subject invention as defined in the appended claims.

We claim:

1. A tool for interconnecting a plurality of piercing contacts with respective ones of a plurality of insulated conductors to form a connector assembly, each of the conductors arranged in parallel and at least one of said conductors exposed on each of a pair of opposed outer surfaces of a wire guide, each of the piercing contacts retained in a cap and such that when the cap is placed over the wire guide each of the piercing contacts is aligned with the respective ones of the conductors, the tool comprising:

a receptacle defining an axis and comprising an opening dimensioned for receiving the cap, wire guide and insulated conductors and a back wall opposite said opening;

a retaining plate adjacent said opening, said retaining plate moveable between a retaining position wherein said retaining plate projects into said opening and an inserting position wherein said retaining plate is outside of said opening;

a pair of blades arranged in parallel and in an opposed relationship on opposite sides of said receptacle between said opening and said back wall, said blades moveable towards one another into a cutting position;

a pair of presses in an opposed relationship on opposite sides of said receptacle between said opening and said back wall, each of said presses adjacent a respective one of said blades and arranged for movement therewith into a pressing position;

wherein said back wall comprises a push plate moveable along said axis towards said opening between a locked position, wherein said push plate is positioned between said pairs of blades and said pairs of presses thereby preventing their movement, and an unlocked position, wherein said push plate is not positioned between said pairs of blades and said pairs of presses; and a pair of elongate actuating handles moveable at right angles to the axis into an actuated position, each of said handles connected to a respective one of said blades;

wherein said push plate is moveable from said locked position to said unlocked position through insertion of said cap and wire guide completely into said receptacle and such that said retaining plate moves from said inserting position to said retaining position, and further wherein when in said unlocked position, movement of said handles into said actuated position moves each of said blades into said cutting position and each of said presses into said pressing position.

2. The tool of claim 1, wherein each of said presses comprises at least one piercing contact-engaging chuck.

3. The tool of claim 2, wherein each of said presses comprises two of said piercing contact-engaging chuck.

4. The tool of claim 1, wherein each of said blades is mounted to a respective one of said presses.

5. The tool of claim 4, wherein each of said blades is removeably mounted to a respective one of said presses.

6. The tool of claim 1, wherein as each of said blades moves into said position, each of said blades cuts for removal ends of a plurality of the conductors.

7. The tool of claim 1, wherein each of said blades is flat.

8. The tool of claim 7, wherein each of said blades is notched to form a pair of cutting edges.

9. The tool of claim 1, wherein each of said blades is replaceable.

10. The tool of claim 1, wherein said retaining plate is moveable at right angles to said axis into said inserting position against a first bias.

11. The tool of claim 10, wherein said first bias is generated by a first spring.

12. The tool of claim 1, wherein said retaining plate is rotated about a rotation axis into said inserting position against a first bias, said rotation axis in parallel to said axis.

13. The tool of claim 1, wherein said blades, said pair of presses, and said pair of elongate actuating handles are moveable against a second bias.

14. The tool of claim 13, wherein said second bias is generated by a plurality of second springs.

15. The tool of claim 14, wherein each of said presses comprises a pair of bores arranged at right angles to said axis, each of said bores for receiving a respective one of a plurality of shafts and further wherein one of said plurality of second springs surrounds each of said shafts.

16. The tool of claim 13, wherein on release of said handles when in said actuated position said blades, said pair of presses, and said pair of elongate actuating handles are returned respectively to a retracted position, a disengaged position and an unactuated position by said second bias.

17. The tool of claim 1, wherein said push plate is moveable against a third bias and such that when said retaining plate is moved into said inserting position from said retaining position, said third bias and said push plate eject the connector assembly from said receptacle.

18. The tool of claim 17, wherein said third bias is generated by a third spring.

* * * * *